US006224386B1

(12) United States Patent
Suzuki

(10) Patent No.: US 6,224,386 B1
(45) Date of Patent: May 1, 2001

(54) SOUND FIELD SIMULATION METHOD AND SOUND FIELD SIMULATION APPARATUS

(75) Inventor: Masaki Suzuki, Tokyo (JP)

(73) Assignee: Asahi Electric Institute, Ltd., Tokyo (JP)

( * ) Notice: Subject to any disclaimer, the term of this patent is extended or adjusted under 35 U.S.C. 154(b) by 0 days.

(21) Appl. No.: 09/397,499

(22) Filed: Sep. 17, 1999

(51) Int. Cl.[7] ..... A63B 69/36

(52) U.S. Cl. ..... 434/252; 434/247; 473/224

(58) Field of Search ..... 434/252, 247; 473/219, 221, 208, 209, 224, 234

(56) References Cited

U.S. PATENT DOCUMENTS

| | | | | |
|---|---|---|---|---|
| 3,808,707 | * | 5/1974 | Fink | 434/252 |
| 5,372,365 | * | 12/1994 | McTeigue et al. | 473/204 |
| 5,558,519 | * | 9/1996 | Sabowitz | 434/247 |
| 5,743,807 | * | 4/1998 | Bendo et al. | 473/234 |

* cited by examiner

*Primary Examiner*—Kien T. Nguyen
(74) *Attorney, Agent, or Firm*—Rothwell, Figg, Ernst & Manbeck

(57) ABSTRACT

There is provided a sound field simulation apparatus to realize a sound field simulation in which an imaginary sound source placed to a club head is made perceptive to a listener so as to be moved along a three-dimensional circular orbit in a sequence of a golf swing movement.

18 Claims, 5 Drawing Sheets

SOUND FIELD SIMULATION METHOD AND SOUND FIELD SIMULATION APPARATUS

BACKGROUND OF THE INVENTION

1. Field of the Invention

The present invention relates to a sound field simulation method and a sound field simulation apparatus utilizing a binaural regeneration in which an amplitude difference and a time difference of a sound signal heard by a listener are changed so as to be made perceptive to the listener as if a spatially imaginary sound source is moved along a three-dimensional circular orbit. More particularly, the invention relates to a sound field simulation method and a sound field simulation apparatus for demonstrating a golf swing by a learner sensing the three-dimensional circular orbit of a club head in a golf swing movement with their body.

2. Description of the Prior Art

Conventionally, in a prior art practice method of a golf swing, there are many visual methods such as the case in which the swing is checked by watching a VTR, or by learning the swing from other person (coach) for example. In such visual methods, an ideal swing is basically imaged to a trainee of the swing to teach the trainee to swing as near as possible as to the ideal swing. Such methods are external practice methods for learning an image (ideal swing) as it is, by means of an apparatus, a teacher or a VTR.

In addition, conventionally, as a teaching method of a golf swing, weight shift is regarded as important. In such a teaching method, the swing movement is explained by a plane movement of from right to left (two-dimension). Such explanation of the swing by using a two-dimensional movement is convenient for logically explaining the swing movement because up to the present time, there is no means (method or apparatus) for creating a perception of a three-dimensional actual movement.

SUMMARY OF THE INVENTION

However, in the visual practice method described above, a body movement in the swing is actually hard for another person to perceive if the ideal swing is imaged, therefore, in such a method, the movement in the person in question may not be understood. In addition, if the practice method is an external one, since the VTR cannot be watched at the moment of ball hitting (moment of impact), the variation of the swing movement at that moment cannot be sensed bodily. Furthermore, a rhythm or a timing thereof is hard to acquire in an external practice method.

Moreover, although there are used many methods to explain the swing by the weight shift, the essential nature of the swing is not shift, but rotational movement. In other words, the swing is not a plane (two-dimensional) movement, but a solid (three-dimensional) movement in which a ball is hit through a circular orbit. Certainly, weight shift is important in the swing. However, the determination of the swing by the two-dimensional movement tends to be prepossessed with a form of the swing. Since there are differences among individuals with respect to the swing, if the circular orbit of the club head is constant or reliable, it is obvious that the swing is suited to that person. If the circular orbit of the club head becomes constant, the person's weight shift can be naturally acquired.

The present invention is proposed to solve the above-mentioned problems, and aims to obtain a sound field simulation method and a sound field simulation apparatus in which the momentary variation of the swing can be bodily sensed by using a visual method and by feeling the circular movement of the three-dimensional swing.

In addition, this invention aims to obtain a sound field simulation method and a sound field simulation apparatus in which replication can be easily performed and a feeling for the swing can be obtained by the sense of hearing without any large device such as a VTR.

Furthermore, there are prior art published documents relative to this invention; Japanese Laid-Open Patent Publication Nos. 4-30700 and 6-30500.

In a sound field simulation method according to the present invention, the imaginary sound source placed to a head of a club is made perceptive to the listener as moved along a three-dimensional circular orbit in a sequence of a golf swing movement.

In a sound field simulation method according to the present invention, the golf swing movement is divided into a plurality of steps, and a time interval is made possible to set in each of the steps In a sound field simulation method according to the present invention, the golf swing movement is divided into five steps: from a tee up with targeting a target place till a set up; from the set up till a top of swing; during said top of swing; from the top of swing till an impact; and from the impact till a finish.

In a sound field simulation method according to the present invention, a sound of the sound source is changed in accordance with a kind of club.

In a sound field simulation method according to the present invention, one of a frequency, volume, and sound and volume of the sound source is changed in a process that the imaginary sound source is moved along the three-dimensional circular orbit.

In a sound field simulation method according to the present invention, squares are assumed in a three-dimensional space, and musical scales are set to the squares in a direction and a transverse direction with reference to the listener. In addition, volume is set to the squares in a back and forth direction (hereafter depth direction) with reference to the listener. This arrangement changes the musical scales and the volume in accordance with the squares corresponding to the three-dimensional circular orbit.

In a sound field simulation method according to the present invention, one of the frequency, the volume, and the sound and volume of the sound source is changed in accordance with a moving speed of the sound source.

In a sound field simulation apparatus according to the present invention, there are provided: a memory means for memorizing sound field information to realize a sound field simulation in which an imaginary sound source placed to a club head is made perceptive to a listener so as to be moved along a three-dimensional circular orbit in a sequence of a golf swing movement; a change means provided to each of right and left ears of the listener, for changing the sound field information into sound signal; a sound generation means provided to each of the right and left ears of the listener, for radiating to the right and left ears of the listener, with the sound signal being changed into a sound wave; and a control means for controlling a regeneration from the sound field information to the sound wave.

In a sound field simulation apparatus according to the present invention, a regeneration speed change means for changing a regeneration speed from the sound field information to sound wave in accordance with a selection signal.

DETAILED DESCRIPTION OF THE PREFERRED EMBODIMENT

An embodiment of the present invention is described below.

Embodiment 1

Figure 1A:
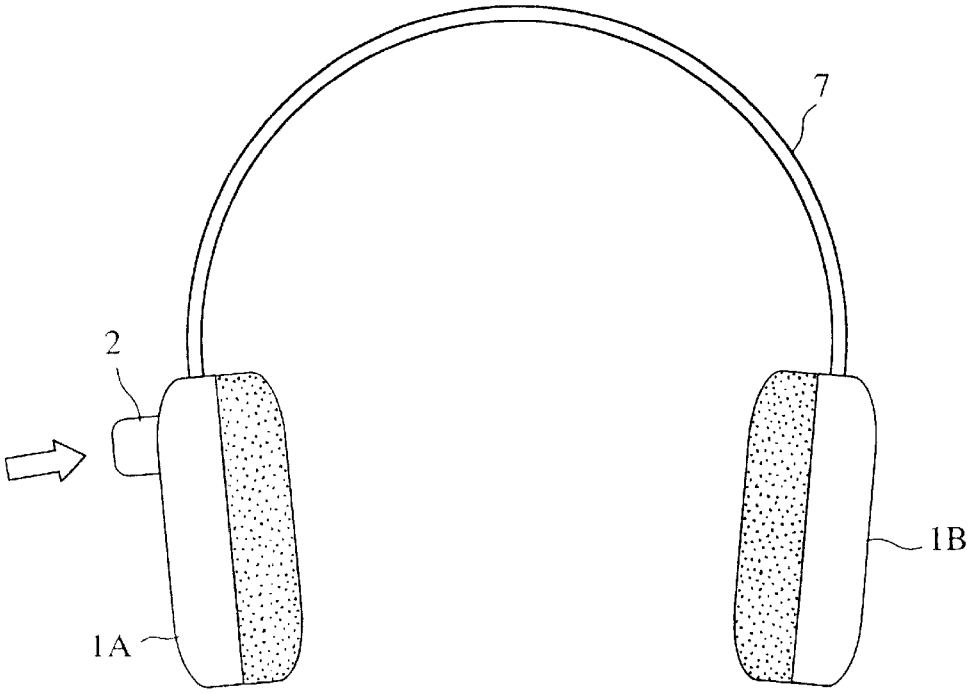
FIG. 1 is a schematic view of a sound field simulation apparatus of a headphone type according to the present invention.
Figure 1B:
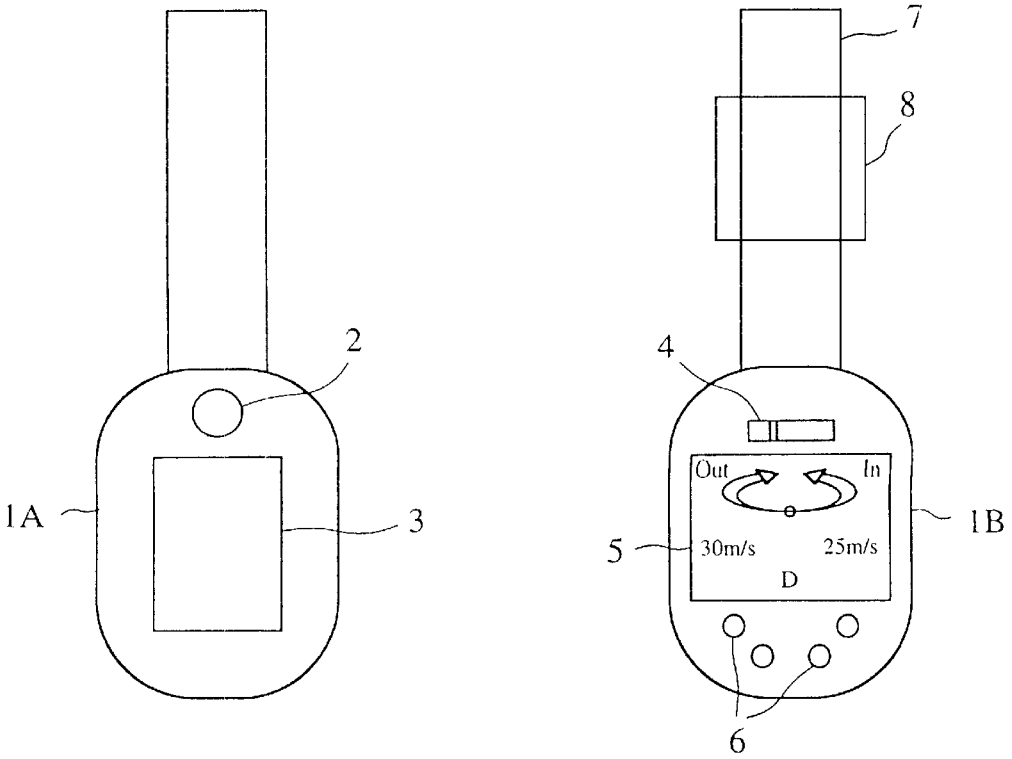

FIG. 1 is general views of a sound field simulation apparatus of a headphone type according to the present invention. In the figure, reference numerals 1A and 1B denote a pair of ear pad portions of a headphone, 2 illustrates a main switch of the sound field simulation apparatus, 3 shows a battery case, and the main switch 2 and the battery case are provided to the ear pad portion 1A. A reference numeral 4 denotes a volume switch for adjusting volume, 5 indicates a liquid crystal display portion for displaying a function selection such as a regeneration speed or a sound quality and so on, 6 shows a level switch for changing the function selection displayed on the liquid crystal display portion 5 (here, it is not limited to four level switches in FIG. 1). The volume switch 4, the liquid crystal display 5 and the level switch 6 are provided to the ear pad portion 1B. A reference numeral 7 denotes a connection portion for determining a mount position with the ear portions 1A and 1B being connected, and an adjusting portion 8 is provided to the connection portion 7, to adjust the length of the connection portion 7 in accordance with the size of a human head.

In addition, although the sound field simulation apparatus is explained by using one of the headphone types in the first embodiment, it is not limited to this type, and may be used as an earphone type or other type.

Figure 2:
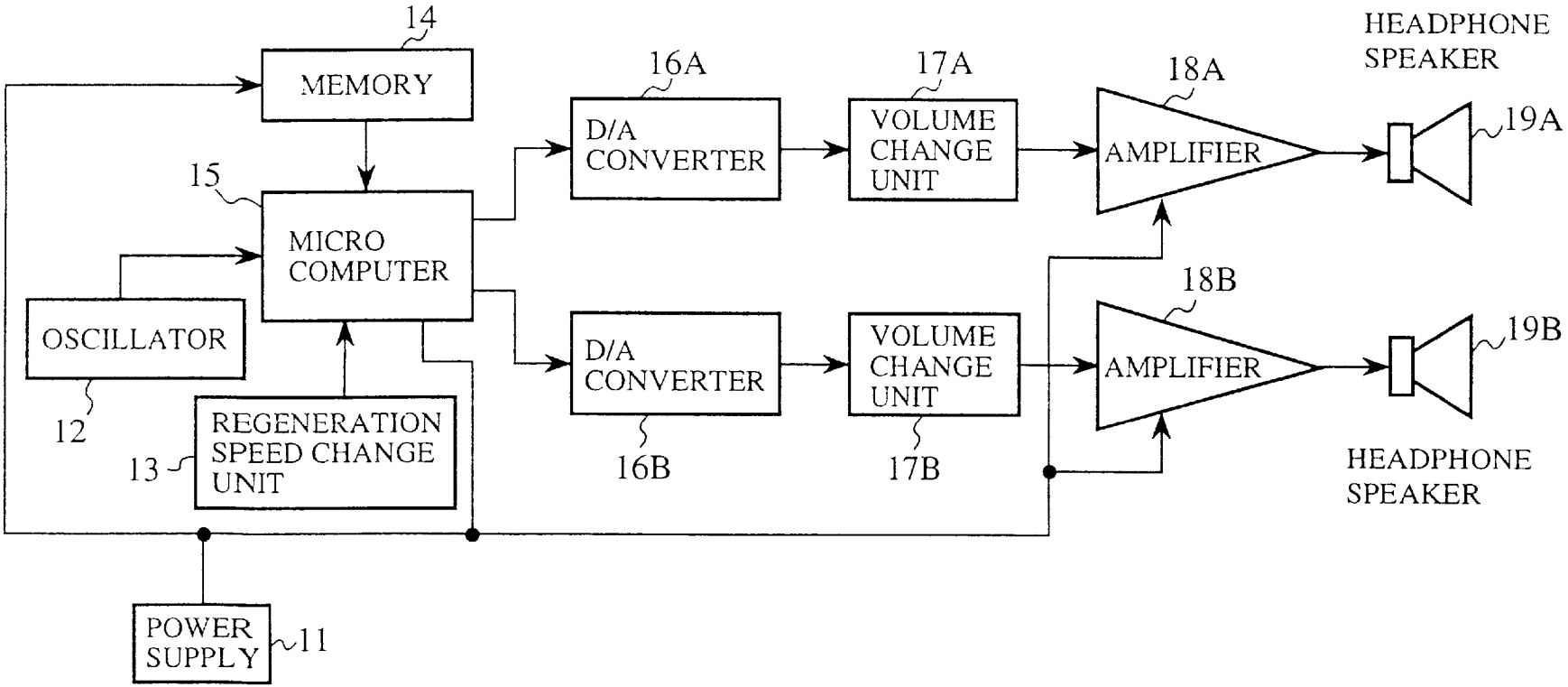
FIG. 2 is a circuit diagram showing a sound field simulation apparatus according to the present invention.

FIG. 2 is a circuit diagram showing a sound field simulation apparatus according to the present invention. In the figure, a reference numeral 11 denotes a power supply, 12 illustrates a oscillator for generating a standard frequency, 13 shows a regeneration speed change unit (regeneration speed change means) for changing the regeneration speed, this regeneration speed change unit 13 changes the regeneration speed in accordance with a selection signal sent from the level switch 6. A reference numeral 14 indicates a memory (memory means) for memorizing digital sound field information (sound field information) to make a sound field, and the sound field information memorized in the memory 14 is recorded by means of a binaural system so as to be realized as a simulation as if a sound source is rotationally moved. A reference numeral 15 shows a microcomputer (control means) for controlling the sound field simulation apparatus.

Reference numerals 16A and 16B denote DIA converter (converting means) for changing the digital sound field information sent from the microcomputer 15 into an analog signal (sound signal), 17A and 17B show volume change units (volume change means) for changing the analog sound signal sent from the D/A converters 16A and 16B in accordance with a control signal sent from the volume switch 4, to change the volume of sound sent from headphone speakers 19A and 19B. Reference numerals 18A and 18B indicate amplifiers for amplifying the analog signals from the volume change unit 17A and 17B, and the 19A and 19B denote headphone speakers (sound generation means) for radiating (sounding) a sound to make a binaural effect. The D/A converters 16A and 16B, the volume change unit 17A and 17B, the amplifiers 18A and 18B, and the headphone speakers 19A and 19B are provided to each of the pair of ear pad portions of a user, and a reference numeral A shows the left side ear, and B shows the right side ear.

In addition, a circuit shown in FIG. 2 is installed in the headphone of FIG. 1. Here, it is not limited to such a headphone, therefore the circuit shown in FIG. 2 may be mounted to an outer unit and constituted such that the sound signal is sent to the headphone from the outer unit.

Next the operation will be described.

(1) First, the binaural (both ears) effect will be described briefly.

People sense a direction or a distance of the sound source because there is a difference in a component of a sound wave transmitted to both right and left ears. Thus, understanding of such a spatial information by hearing, such as a sense of a sound source direction or the like, is performed by sensing the amplitude of the sound wave and the spatial difference received at the both ears by binaural hearing. Such sensing of the spatial information by the binaural hearing is called the binaural effect (auditory localization effect).

Therefore, when a sound signal received near the eardrum of both ears is collected to be regenerated with a headphone by using the signal, a true presence can be realized. This is the basic premise of binaural regeneration.

In this invention, a recording method of the sound field information for realizing the sound field simulation of a golf swing is performed by means of the binaural system. To separate sound source information from localized information, the sound signal is applied as one-channel dry source signal including only a direct sound component by a proximity recording in an echoic chamber or an electric synthetic sound, and a transmission characteristic for the both ears is superimposed to generate two-channel binaural signals.

The sound field information recorded by the binaural system mentioned above is memorized in the memory 14 shown in FIG. 2. Therefore, a listener can hear as if an imaginary sound placed with respect to a club head is rotated in three dimensions.

(2) Next, an operation for regenerating the digital sound field information memorized in the memory 14 will be described in the sound field simulation apparatus shown in FIG. 2.

As mentioned above, the sound field simulation in which the imaginary sound source is three-dimensionally rotated and moved can be realized by reading out the sound field information memorized in the memory 14 by means of the binaural system, and by regenerating the sound field information from the pair of speaker 19A and 19B.

First, the sound field information memorized in the memory 14 is read out by the microcomputer 15. Then a regeneration speed control signal from the regeneration speed change unit 13 is sent to the microcomputer 15 to determine a regeneration speed thereof. The operation of the microcomputer 15 is performed in accordance with a clock timing of the standard frequency from the oscillator 12. The sound field information read out from the memory 14 is sent to the D/A converters 16A and 16B at both sides to be converted from a digital sound field information to analog sound signals. The converted analog sound signals are respectively sent to the volume change units 17A and 17B at the both sides, to change the volume in accordance with the control signal from the volume switches 4. Therefore, the analog signals from the volume change units 17A and 17B are amplified through the amplifiers 18A and 18B, to be radiated by changing into the sound waves at the headphone speakers 19A and 19B respectively, whereby the sound for realizing the sound field simulation is heard. Such regenerated sounds are components of the sound waves from the right and left headphone speakers 19A and 19B. Thus a binaural effect is created which makes the spatial information perceptible.

(3) Next, a common swing movement will be described.

Figure 3:
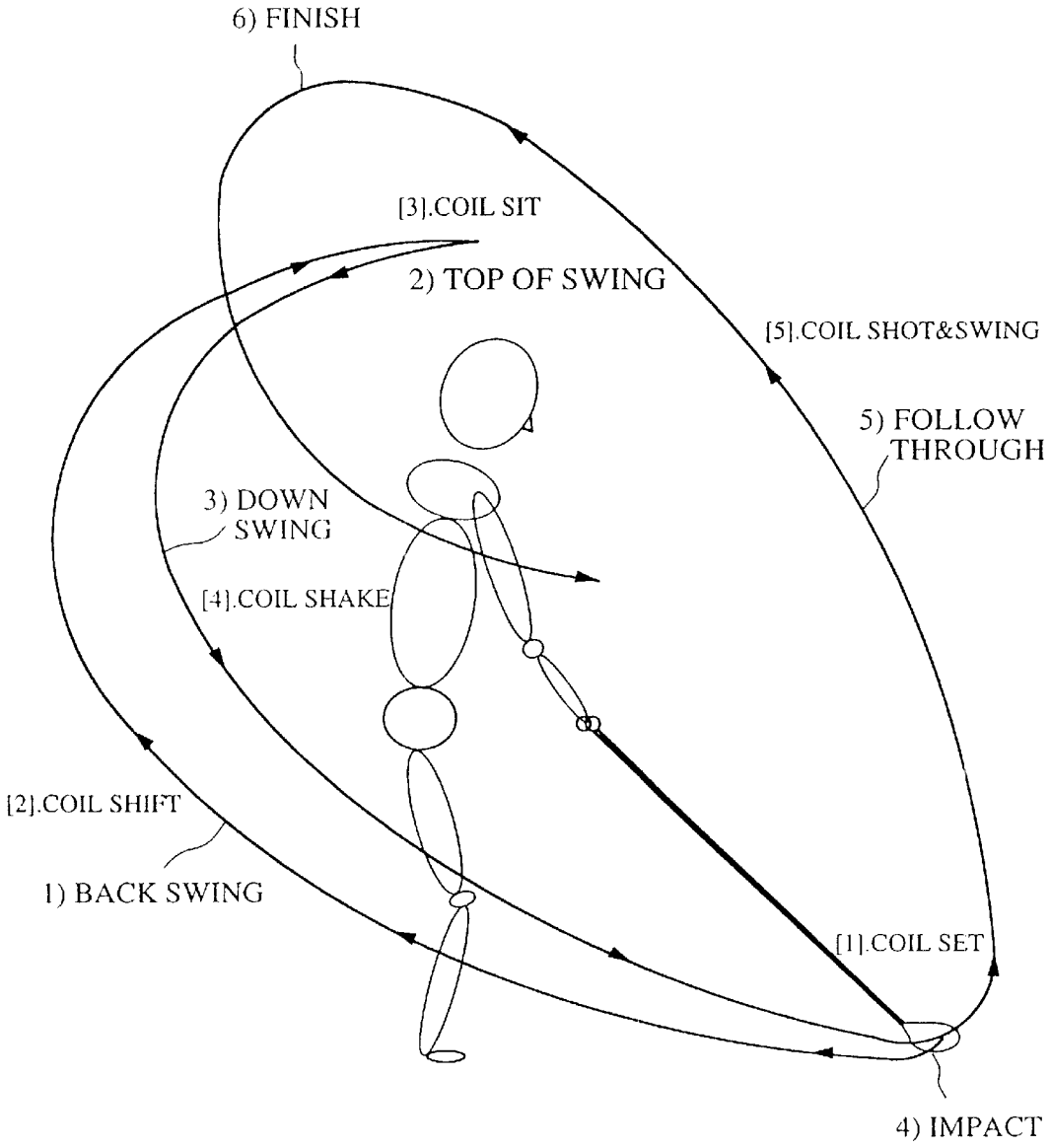
FIG. 3 explains a golf swing movement.

FIG. 3 is a view for explaining a golf swing movement. The movement of the golf swing can be divided into six steps as follows.

1) Back swing

This is a movement in which the club is lifted up from the start of swing till the club head is reached to the top. In this movement, a power is stored in accordance with the rotation of the body.

2) Top of swing

This is a state in which the club head is at the top position and momentarily stopped the so-called an "accumulation" movement. This status has the maximum accumulated power.

3) Down swing

This is a movement in which the club is swung down from the top position till an impact. The twisted body is recovered to release the accumulated power.

4) Impact

Impact is a moment in which the ball is hit by the club head.

5) Follow through

This is a movement in which the club is rotated with the body being twisted after impact.

6) Finish

This is a state in which the swing is terminated after the follow through.

(4) Next, the sound which is actually heard to the listener from the sound field simulation apparatus (headphone), i.e., the sound realizing the sound field simulation, and the swing movement of the listener who has heard the sound will be described with reference to FIG. 3.

Although the movement of the golf swing can be classified into the six steps as described above, this sound field simulation has five steps. In the simulation, also there is a step from a tee up with targeting a target place till a set up, and movements of an impact, a follow through and a finish are regarded as one step. Here, a movement from the determination of ball hitting till the finish is called a preshot routine.

The steps from the tee up with targeting the target place till the set up is established for the following reasons. Namely, in a ideal golf swing, a sequence of from the tee up with targeting the target place till the set up, from the set up till the start of the swing, and the finish of the swing is performed by a predetermined rhythm. Therefore, a simulation in which a timing from the tee up till set up is also made constant is established, thus the movement of the sequence from the tee up till the finish of the swing is simulated. A muscle memory is performed by repeating such a preshot routine, so that it is possible to make the swing constant.

In addition, the reason for establishing the movement from the impact via the follow through till the finish as one step is as follows. In the sound field simulation of the golf swing, since each movement of the impact, the follow through and the finish is performed within a very short time interval, even if these movements are divided, the listener cannot distinguish. Accordingly, if the number of steps is made small, the amount of the memory 14 can be also small, thereby minimizing the size of the apparatus. Therefore, the impact, the follow through and the finish are established as one step in the simulation.

Furthermore, the simulation need not be divided into five steps, it may be divided in accordance with the structure of the apparatus or the status of the simulation. For instance, the simulation can be performed by dividing the movements into the impact, the follow through and the finish.

Moreover, in FIG. 3, the representation of the simulation steps is [1] COIL SET; [2] COIL SHIFT; [3] COIL SIT; [4] COIL SHAKE; and [5] COIL SHOT & SWING, because a golf swing is a three-dimensional circular movement, or a body twist is utilized to make a head speed, so that it can be used a simple metaphor as a rewinding movement of coil.

At first, the right and left of the ear pad are checked and the headphone (sound field simulation) is placed in the ON position.

[1] From the tee up till the set up (COIL SET)

When the main switch 2 of the sound field simulation apparatus is pushed, a deep breath sound is heard for 5 seconds until the starting of the swing to adjust a balance of the body set up. Here, the set up is a state in which the club is positioned.

Then, after 1 second (no sound in this 1 second), an oscillation sound (beep) is heard, wherein the oscillation sound is perceived by the user as emanating from the location of the imaginary club head. The swing is started in corresponding to this oscillation sound.

Although the time interval of the set up state is 5 seconds as a standard, it may be selectively set to 8 steps.

Furthermore, when swings before a shot are performed, the swing sound may be heard, and when waggles are performed, the waggle sound may be transmitted to the listener on the set up, for example. In addition, a voice sound may be heard instead of the oscillation sound.

Moreover, the oscillation sound (beep) which is a sign for starting the swing may be changed in accordance with the kind of the club as a beep sound if the club is wood, and a peep sound if the club is iron.

[2] From the set up till the top of swing (COIL SHIFT)

The oscillation sound, which is perceived by the user as if it is placed on the imaginary club head is shifted to the top gradually along the ideal circular orbit of the imaginary club head. The listener twists the body with the actual club head in accordance with the position of the sound source. This is a back swing movement. The standard time interval of the back swing movement is 0.8 second. The time interval may be selectively set to 16 steps.

[3] During the top of swing (COIL SIT)

When the club is positioned at the top, the imaginary sound source becomes silent. During the top of swing, the body is twisted and the power is accumulated as the maximum. This state is called an accumulation state since the club head is momentarily stopped. The time interval of the momentary stop state of the club head is 0.5 second as the standard. This time interval may be selectively set to 8 steps.

Here, during the top position, the sound may be emphasized with the higher sound instead of the silence.

[4] From the top of swing till the impact (COIL SHAKE)

The sound source positioned at the top is shifted in accordance with the head speed along the circular orbit. The twisted body is released in accordance with the sound source with the club head being moved. This is a down swing movement. The standard time interval for this down swing is 0.5 second. This time may be selectively 16 steps in accordance with a time interval till the hitting of the ball (head speed).

[5] From the impact till the finish (COIL SHOT & SWING)

An impact sound is heard at the impact. The impact sound is made heard from the front of the listener with the volume being established as equal between both ears. In the head up when the listener shoots the ball, the impact sound is emphasized to the right ear. The listener can practice such that the impact sound is heard from the front side by making the impact sound from the front side, thereby to possible to avoid the head up. Then, after the impact sound, the sound source is shifted along the circular orbit, and reaches the finish via the follow through. Therefore, the listener hits the ball in accordance with the impact sound, with the club rolled into the body. The time interval from the impact till the finish is 0.5 second as a standard. This time interval may be selectively set to 16 steps.

The impact sound may be selected in corresponding to a shot on a grass field using an iron, a bunker shot, a shot using a wood driver, or a shot by using a titanium head. In addition, the sound by using a putter may be selected.

Furthermore, a sound from a state in which the club crosses the body (down swing) till a state that the club twists the body (follow through and finish) may be represented a larger sound than that of the back swing described in [2].

Although the standard time interval of the swings from [2] to [5] is 2.3 seconds in total, the optimum simulation movement for individual person can be made by selectively setting with each of the movement described above.

In addition, although the time setting is performed by means of the 8 steps or the 16 steps, it may be established more or less than this time interval.

Furthermore, the sound heard from the headphone is used as mechanical sound which does not exist in nature because the position of the imaginary sound source is exactly heard to the listener. Here, it is not limited to the mechanic sound, but the natural sound may be used as a wind sound for example.

(5) Next, a method to set the simulation for the swing speed (head speed) or the timing of individual listener will be described.

Figure 4:
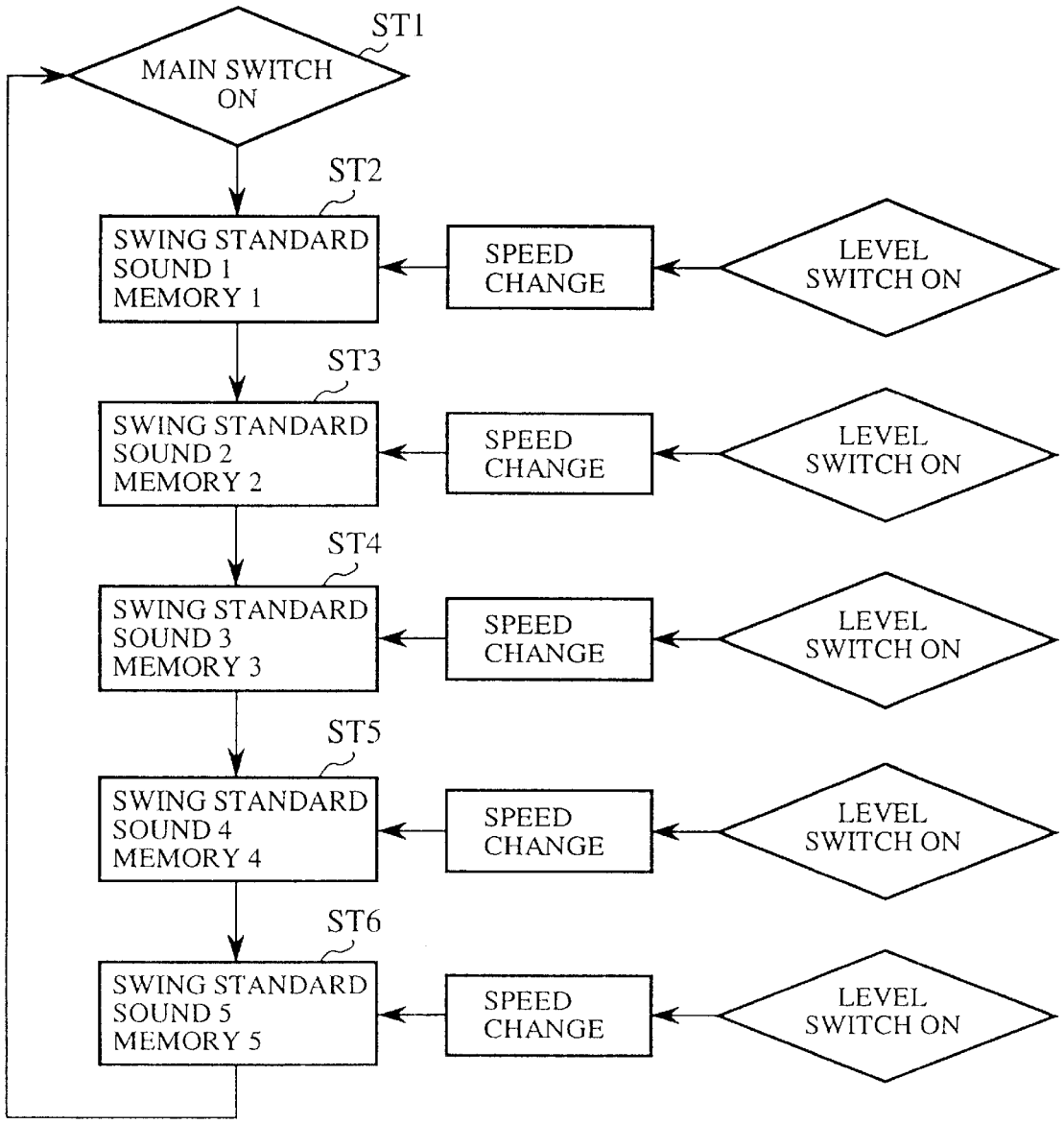
FIG. 4 is a flow chart explaining one example of a case in which the simulation divided into the 5 steps is adjusted in time by each of the steps.

FIG. 4 is a flow chart for explaining one example of a case in which the simulation divided into the 5 steps is adjusted in time by each of the steps.

When the main switch 2 is pushed (step ST1), the sound in which the sound source placed at the club head is three-dimensionally rotated from the tee up state till the finish of the swing described above is heard from the head phone speaker (sound field simulation apparatus), and the listener performs in accordance with the sound. Basically, the sequence of the sound for the simulation is heard only one time if the main switch 2 is pushed. The listener sets the time from the tee up till the set up in accordance with the rhythm of the listener, after the sequence of the swing movement (step ST2). Then the time interval of the back swing for the listener is set by hearing the simulation sound with the main switch 2 being pushed (step ST3). Similarly, the time interval of the top of swing is set (step ST4), and the time interval of the down swing is set (step ST5), as well as the time interval of the impact, the follow through and the finish is set (step ST6).

In addition, the setting such time intervals may not required to follow the steps shown in FIG. 4, and the time interval of the down swing may be set at first for example.

As mentioned above, according to the present invention, since the listener hears the circular movement of the three-dimensional swing in order to make a swing in accordance with a shift in the sound by hearing the different components of the sound wave through head phones, momentary variations in the swing can be made perceptive.

Furthermore, such a sound field simulation apparatus can generate replications easily without any large device such as a VTR.

The swing practice can be performed by hearing through headphones, so that there is no obstacle for swing practice.

Embodiment 2

In the above-mentioned first embodiment, the sound in which the direction and the distance of the sound source are to be made perceptive is heard to the listener, to be made perceptive the imaginary sound source being shifted along a three-dimensional circular orbit, and the swing can be demonstrated by making the club head correspond to the sound source. However, in the second embodiment, a musical scale or volume are further set in accordance with the spatial position of the imaginary sound source to facilitate the understanding of the spatial information.

Figure 5A:
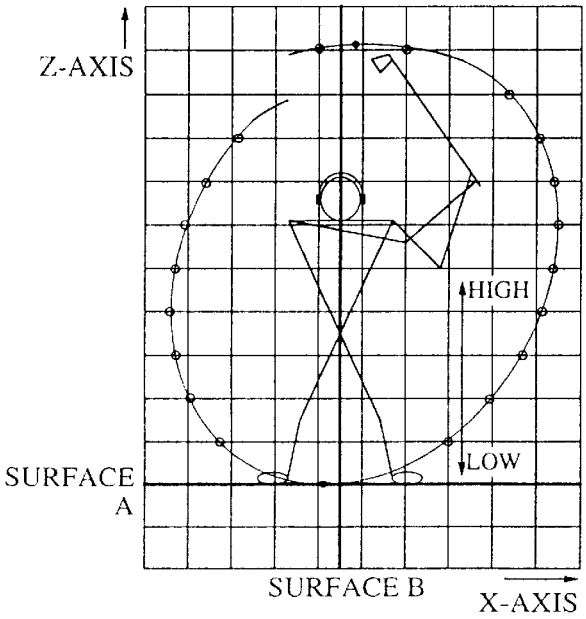
FIG. 5 explains one example of a way to set a musical scale or volume.
Figure 5B:
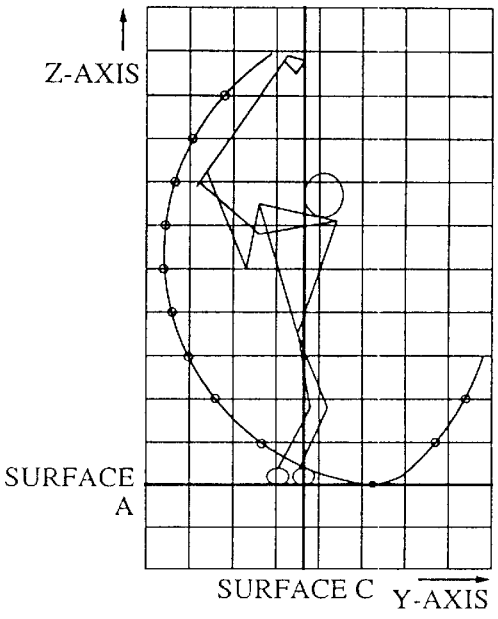
Figure 5C:
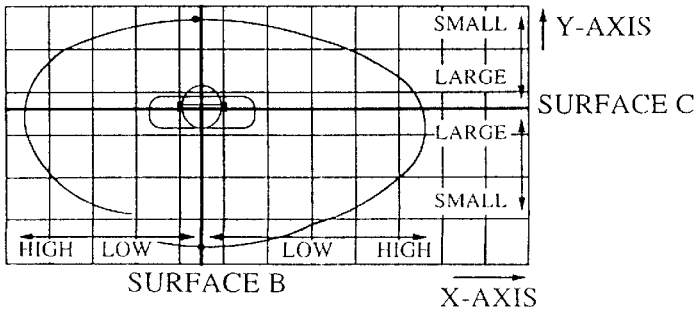

FIG. 5 is a diagram explaining one example of the way to set such a musical scale or volume, and (a) shows a case viewed from the behind; (b) shows a case viewed from the right side; and (c) shows a case viewed from the upper side.

Squares are spatially assumed around a person (listener) as shown in FIG. 5. An X-axis is established in the transverse direction with reference to the person, and a Y-axis is established in the depth direction with reference to the person, as well as a Z-axis is established in the vertical direction with reference to the person. The spatial position of the Z-axis (vertical direction) and the X-axis (transverse direction) is distinguished by the musical scale. The standard of the musical scale in the Z-axis direction is surface A (ground). The musical scale becomes gradually high in accordance with the height of the squares with reference to surface A as a base. The standard of the musical scale in the X-axis direction is B surface (YZ surface including the center axis of the person). The musical scale becomes gradually high in accordance with the width of the transverse direction of the squares with reference to the B surface as a base. The standard of the musical scale in the Y-axis direction is C surface (XZ surface including the center axis of the person). The musical scale becomes gradually high in accordance with the width of the depth direction of the squares with reference to the C surface as a base. Thus, musical scales and volumes are set to distinguish the spatial position of the club head. In addition, the setting way of the standard musical scales and volumes is not limited to the above description.

Furthermore, each of the squares determined in space may be set large for a beginner, small for senior and fine for professional with reference to the musical scales and volumes.

Thus, the vertical direction and the transverse direction are represented by the musical scales, so that the position of the sound source (club head) is represented by cords.

The sound field simulation in the case in which the musical scales and the volumes are set as mentioned above will be described as follows.

[1] From the tee up till the set up

The sound of the sound source is the same as of the first embodiment, so that the description thereof will be omitted.

[2] From the set up till the top of swing

The set chords of-the musical scales are transmitted to the listener in accordance with the spatial position of the sound source. The musical scale in the vertical direction is gradually changed from a low tone to a high tone, and the musical scale of the transverse direction is gradually changed from a high tone to a low tone, then from the low tone to the high tone. In addition, the volume of the depth direction is gradually changed from large to small, then from small to large.

[3] During the top of swing

The device is silent similar to the first embodiment.

[4] From the top of swing till the impact

The musical scale in the vertical direction is gradually changed from the high tone to the low tone, and the musical scale of the transverse direction is gradually changed from the low tone to the high tone, then from the high tone to the low tone. In addition, the volume of the depth direction is gradually changed from large to small, then from small to large

[5] From the impact till the finish

The musical scale in the vertical direction is gradually changed from the low tone to the high tone, and the musical scale of the transverse direction is gradually changed from the low tone to the high tone, then from the high tone to the low tone. In addition, the volume of the depth direction is gradually changed from large to small, then from small to large.

Thus, the listener can exactly comprehend the position of the sound source by setting the musical scales and the volumes to the position of the spatial sound source (club head).

In addition, although the musical scales and the volumes are set to the squares, with the squares being assumed to the space, the frequency and volume are changed subsequently in accordance with the positions of the basic surfaces of A, B and C without any setting of the squares.

The way of setting a musical scale (or frequency) is not limited to the procedure shown in FIG. 5, and there are many ways to set the device. For example, the following is considered.

Firstly the volume may be changed in accordance with the head speed. The volume is made large if the head speed is large, and smaller if the head speed is small.

Secondly the musical scale (or frequency) may be changed in accordance with the head speed. The frequency is increased if the head speed is large, and decreased if the head speed is small.

Thirdly the volume may be changed in accordance with the accumulated power. The volume is made large if the power is accumulated with the body being twisted, and small if the body is rewound (released).

Fourthly the musical scale (or frequency) may be changed in accordance with the accumulated power. The frequency is increased if the power is accumulated with the body being twisted, and decreased if the body is rewound (released).

The musical scale and the volume may be changed in consideration with the Doppler effect. Namely, the frequency is decreased after the club head has passed in front of the person.

Furthermore, these setting ways may be combined.

As described above, according to the second embodiment, since the sound of the sound source is changed in accordance with the position of the imaginary sound source, the spatial position of the sound source can be made perceptive (understand). In addition, since the sound of the sound source is changed in accordance with the head speed (moving speed of the sound source), the sound field simulation can be more readily realized.

Moreover, in the first embodiment described above, although the simulation is divided into 5 steps to gradually select and set, a standard time may be applied for a beginner and senior may be selected.

In addition, sounds such as gallery, birds or wind may be included in the simulation other than the sound source placed to the club head.

Furthermore, although the simulation of the golf is explained in the above-mentioned embodiment, it is not limited to this, so that can be applied to any sports such as a bat swing in baseball or a pitching form for baseball.

As mentioned above, according to the present invention, since the imaginary sound source placed to the head of the club is made perceptive to the listener so as to be moved along the three-dimensional circular orbit in the sequence of the golf swing movement, a constant reliable circular orbit can be acquired, and since the golf swing is performed in an embodiment having the sound field simulation, momentary variations in the swing can be felt. Moreover, there is an effect that the timing and rhythm of the golf swing can be exactly acquired.

According to the present invention, since the golf swing movement is divided into the plurality of steps, and a time interval is made possible in which each of the steps can be set, there is an effect that the sound field simulation for individual listeners can be made.

According to the present invention, since the golf swing movement is divided into five steps: from the tee up with targeting the target place till the set up; from the set up till the top of swing; during the top of swing; from the top of swing till the impact; and from the impact till the finish, there is an effect that the sound field simulation can be easily made in accordance with the golf swing movement. In addition, since the simulation includes the sequence of the movement from tee up till the termination of the swing, with the simulation in which the timing from the tee up till the set up is made constant, there is an effect that the sequence from the tee up till the termination of the swing through the set up can be performed with a constant rhythm.

According to the present invention, since the sound of the sound source is changed in accordance with the kind of the club, there is an effect that the sound field simulation can be more readily realized.

According to the present invention, since one of frequency, volume, and sound and volume of the sound source is changed in the process that the imaginary sound source is moved along the three-dimensional circular orbit, there is an effect that a sound field simulation having more presence can be realized.

According to the present invention, since squares are assumed in the three-dimensional space, and musical scales are set to the squares in a vertical direction and transverse direction with reference to the listener, as well as volume is set to the squares in depth direction with reference to the listener, to change the musical scales and the volume in accordance with the squares corresponding to the three-dimensional circular orbit, there is an effect that the sound field simulation in which the spatial position of the sound source can be acquired more exactly can be obtained.

According to the present invention, since one of frequency, the volume, and sound and volume of the sound source is changed in accordance with the moving speed of the sound source, there is an effect that the head speed is transmitted to the listener and the sound field simulation having more presence can be realized.

According to the present invention, since there are provided: the memory means for memorizing sound field information to realize the sound field simulation in which the imaginary sound source placed to the club head is made perceptive to the listener so as to be moved along the three-dimensional circular orbit in the sequence of the golf swing movement; the change means provided to each of right and left ears of the listener, for changing the sound field information into sound signal; the sound generation means provided to each of the right and left ears of the listener, for radiating to the right and left ears of the listener, with the sound signal being changed into the sound wave; and the control means for controlling the regeneration from the sound field information to the sound wave, there is an effect that the constant and reliable circular orbit of the club head can be acquired without a large device such as a VTR, thereby easily generating the sound field simulation for individual listeners.

According to the present invention, since the regeneration speed change means for changing the regeneration speed from the sound field information to sound wave in accordance with the selection signal, there is an effect that the regeneration speed of the sound field simulation can be changed to easily generate the sound field simulation for individual listeners.

The preferred embodiments of the present invention were described above, but the descriptions are only for illustrations, and it should be interpreted so that variations and changes of the above descriptions may be performed without departing from the spirit and the scope of the following claims.

What is claimed is:

1. A sound field simulation methods, comprising the steps of generating and radiating from a pair of sound generation means a sound wave having a different sound component in a transverse direction such as a difference in amplitude and a time difference at the right and left sides of a listener, such that said sound wave is heard by said listener and is perceived as the movement of an imaginary sound source, wherein in a golf swing movement sequence, said imaginary sound source is perceived by said listener as if it were placed on a head of an imaginary club and moved along a three-dimensional circular orbit.

2. A sound field simulation method according to claim 1, wherein said golf swing movement is divided into a plurality of steps, and a time interval is made possible to set each of said steps.

3. A sound field simulation method according to claim 2, wherein said golf swing movement is divided into five steps: from a tee up to targeting a target place till a set up; from said set up till a top of a swing; during said top of a swing; from said top of a swing till an impact; and from said impact till a finish.

4. A sound field simulation method according to claim 1, wherein a sound of said sound source is changed in accordance with a kind of said club.

5. A sound field simulation method according to claim 1, wherein one of a frequency, volume, and sound and volume of said sound source is changed in a process in which said imaginary sound source is moved along said three-dimensional circular orbit.

6. A sound field simulation method according to claim 1, wherein squares are assumed in a three-dimensional space, and musical scales are set to said squares in a vertical direction and transverse direction with reference to said listener, and volume is set to said squares in a depth direction with reference to said listener, to change said musical scales and said volume in accordance with said squares corresponding to said three-dimensional circular orbit.

7. A sound field simulation method according to claim 1, wherein one of said frequency, said volume, and said sound and volume of said sound source is changed in accordance with a moving speed of said sound source.

8. A sound field simulation apparatus comprising:

a memory means for memorizing sound field information to realize a sound field simulation in which an imaginary sound source is made perceptible to a listener as if it were placed on an imaginary club head and moved along a three-dimensional circular orbit in a sequence of a golf swing movement;

conversion means provided for each of the right and left ears of said listener, for changing said sound field information into sound signals;

a sound generation means provided to be placed proximate each of said right and left ears of said listener, for receiving said sound signals, changing said sound signals into sound wave, and radiating said sound waves to said right and left ears of said listener; and a control means for controlling regeneration of said sound field information into said sound wave.

9. A sound field simulation apparatus according to claim 8, further comprising a regeneration speed change means for changing a regeneration speed of said sound field information into said sound waves in accordance with a selection signal.

10. A sound field simulation method for providing locational sounds as a teaching guide to a user in practicing an athletic movement, comprising the steps of:

generating binaural sound waves corresponding to predetermined sounds which, when applied to the ears of said user, appear to emanate from predetermined sequential locations around the user in a three-dimensional sound field, said predetermined sequential locations corresponding to desired locations of said athletic movement; and applying said generated binaural sound waves to the ears of said user.

11. A sound field simulation method according to claim 10, wherein said athletic movement is a golf swing movement, said golf swing movement is divided into a plurality of steps, and a time interval is made possible to set each of said steps.

12. A sound field simulation method according to claim 11, wherein said golf swing movement is divided into five steps: from a tee up to targeting a target place till a set up; from said set up till a top of a swing; during said top of a swing; from said top of a swing till an impact; and from said impact till a finish.

13. A sound field simulation method according to claim 11, wherein a sound of said sound source is changed in accordance with a kind of golf club being used in said golf swing.

14. A sound field simulation method according to claim 10, wherein one of a frequency, volume, and sound and volume of said binaural sound waves are changed in a process in which said predetermined sounds are perceived to be moving along a three-dimensional circular orbit about said user.

15. A sound field simulation method according to claim 14, wherein squares are assumed in said three-dimensional sound field, and musical scales are set to said squares in a vertical direction and a transverse direction with reference to said user, and volume is set to said squares in a depth direction with reference to said user, to change said musical scales and said volume in accordance with said squares corresponding to said three-dimensional circular orbit.

16. A sound field simulation method according to claim 10, wherein one of said frequency, said volume, and said sound and volume of said predetermined sounds are changed in accordance with a moving speed of said athletic movement being practiced.

17. A sound field simulation apparatus, comprising:

a memory for storing three-dimensional binaural sound field information corresponding to predetermined sounds which, when applied to the ears of a user, appear to emanate from predetermined sequential locations around the user in a three-dimensional sound field, said predetermined sequential locations corresponding to desired locations of an athletic movement of the user;

a converter device for converting said sound field information into three-dimensional binaural sound signals;

a transducer device for converting said binaural sound signals into sound waves applied to the ears of said user; and a controller for controlling a timing of said sound field information into said binaural sound signals.

18. A sound field simulation apparatus according to claim 17, further comprising a regeneration speed change means for changing a regeneration speed of said sound field information into said sound waves in accordance with a selection signal.

* * * * *